United States Patent [19]

Murphy

[11] 4,388,789

[45] Jun. 21, 1983

[54] CLOSURE APPARATUS FOR BUILDING PANELS

[76] Inventor: Wesley T. Murphy, 947 Prospect St., Auburn, N.Y. 13021

[21] Appl. No.: 219,263

[22] Filed: Dec. 22, 1980

[51] Int. Cl.[3] ..... E04D 1/00

[52] U.S. Cl. ..... 52/461; 52/762

[58] Field of Search ..... 52/461, 520, 762, 465

[56] References Cited

U.S. PATENT DOCUMENTS

| | | | |
|---|---|---|---|
| 2,855,871 | 10/1958 | Huntington | 52/461 |
| 3,381,426 | 5/1968 | Heidrich | 52/461 |

FOREIGN PATENT DOCUMENTS

| | | | |
|---|---|---|---|
| 139050 | 10/1950 | Australia | 52/520 |
| 733606 | 7/1955 | United Kingdom | 52/461 |

*Primary Examiner*—J. Karl Bell

*Attorney, Agent, or Firm*—Bruns & Jenney

[57] ABSTRACT

Apparatus for providing a secure weathertight joint between a pair of coplanar building panels that includes a web passing upwardly through the seam of the joint. A pair of opposed downwardly turned runners depend obliquely from either side of the raised web and along the entire length of the joint. The adjacent ends of the two panels that form the seam are turned upwardly to pass under the runners. An elongated V-shaped spring closure is seated upon the runners with the inside surface of each closure leg being biased against the top surface of one of the runners. A locking pad is secured to the inside wall of each closure leg that snaps over the end of the adjacent runner to secure the parts in assembly.

2 Claims, 3 Drawing Figures

CLOSURE APPARATUS FOR BUILDING PANELS

BACKGROUND OF THE INVENTION

This invention relates to a lightweight composite building structure that is formed by a combination of standardized elements that are brought together to create a secure weathertight joint between building panels that can be quickly and accurately installed without the use of special tools or the like.

In the construction of lightweight or prefabricated buildings, the finished structure must be rigid yet have a pleasing, relatively clean appearance. Typically, preformed panels are assembled at the erection site to the component parts of the structure. Forming a strong weathertight joint between the panels is essential to insure the integrity of the structure.

In many prefabricated structures, the building panels are secured to support columns by means of screws, bolts or other types of threaded fasteners. Threaded fasteners are oftentimes difficult to conceal and therefore detract from the aesthetic value of the structure. By the same token, each threaded fastener represents a critical point where various types of corrosion can occur particularly when the fastener is exposed to moisture. As is well known, the use of threaded fasteners greatly increases the amount of time needed to erect the structure and also increases the cost of the unit.

In order to shorten assembly time, wall systems have been devised, such as that disclosed in U.S. Pat. No. 1,998,688, in which the individual wall panels are placed in abutting contact and joined by means of specially prepared clips. In this type of environment, the wall panels are assembled without the aid of screws or the like. However, the seam or joint formed between the panels remains open and unprotected. As a consequence, wind and moisture can easily penetrate the joint and this type of joint is generally found unsuitable for outdoor use in the construction of walls and roofs.

SUMMARY OF THE INVENTION

It is therefore an object of the present invention to improve the construction of lightweight and prefabricated structures.

A further object of the present invention is to improve the integrity of the joint formed between a pair of abutting roof or wall panels.

A still further object of the present invention is to provide a simple panel joint that does not require the use of threaded fasteners to close the assembly.

Another object of the present invention is to provide a simply operated snap-on closure device for cojoining a pair of coaligned building panels in assembly.

Yet another object of the present invention is to provide an easy to install weathertight closure for securing aligned building panels in assembly.

Still another object of the present invention is to reduce the amount of time required to erect lightweight or prefabricated buildings.

A still further object of the present invention is to provide a secure and weathertight joint between building panels that can be quickly assembled without the need of special tools.

These and other objects of the present invention are attained by means of a secure weathertight joint for cojoining a pair of building panels in assembly that includes an upwardly extended web that passes upwardly through the seam formed by adjacent edges of the panels. The raised portion of the web terminates in a pair of downwardly turned runners that traverse the length of the joint. The runners are cantilevered from both sides of the web. The abutting ends of the two panels that form the seam are turned upwardly to pass under the runners. An elongated V-shaped closure spring is seated on top of the runners with the inside surface of each closure leg being biased into contact against the top surface of the underlying runner. A locking pad is secured to the inside surface of each closure leg which snaps under the edge of the underlying runner to securely close the assembly.

BRIEF DESCRIPTION OF THE DRAWINGS

For a better understanding of these and other objects of the present invention, reference is had to the following detailed description of the invention which is to be read in conjunction with the accompanying drawings, wherein.

DESCRIPTION OF THE INVENTION

Figure 1:
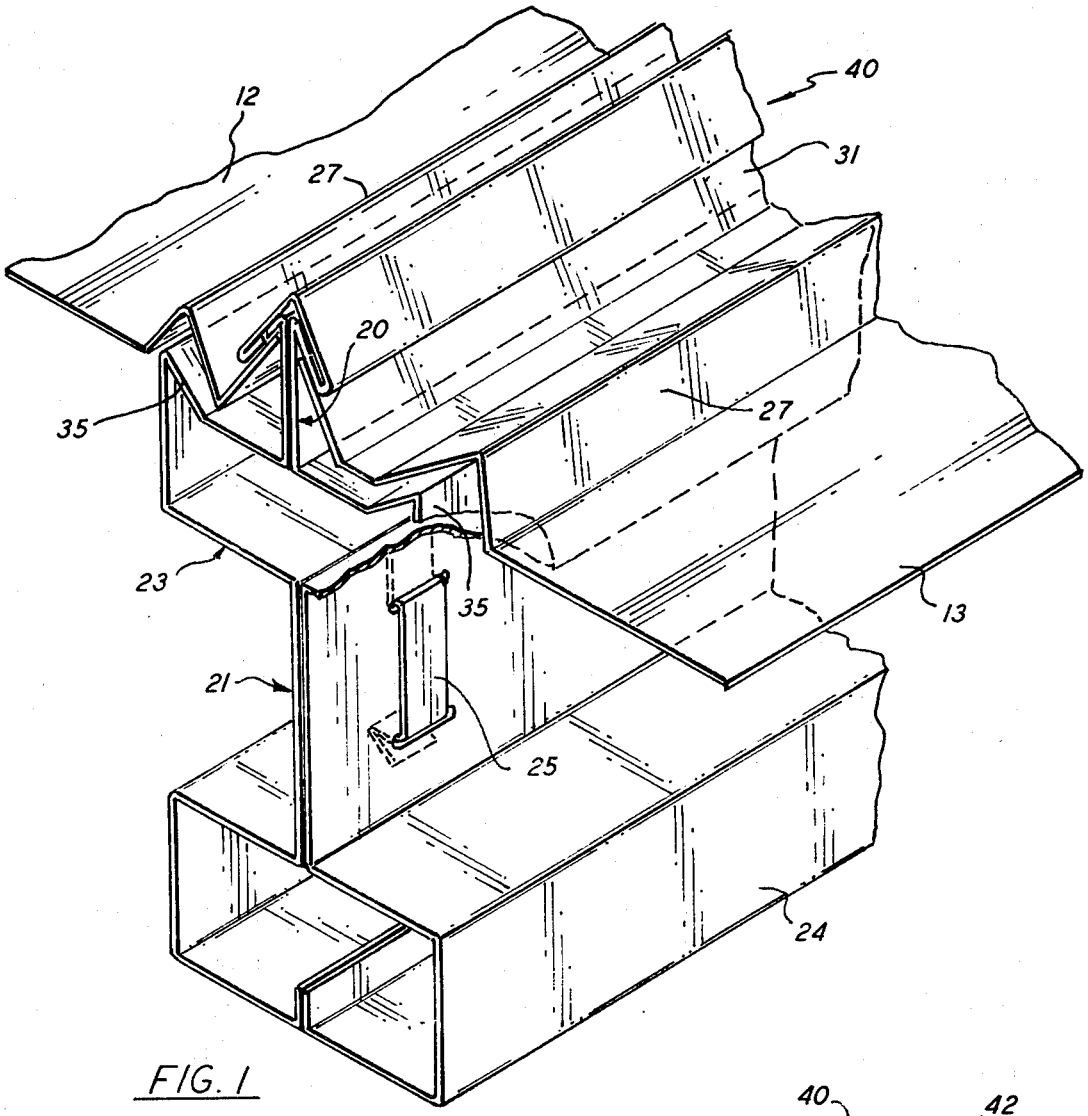
FIG. 1 is a perspective view illustrating apparatus for closing the seam formed by adjacent edges of two building panels to create a secure weathertight joint that encompasses the teachings of the present invention.

Referring now to the drawings, wherein like numbers indicate like parts, the apparatus of the present invention, which is generally referenced 10, is shown used in a roof panel assembly to provide a secure weathertight joint between adjacent coplanar roof panels. Although the apparatus will be described in reference to a roof system, it should be evident from the disclosure below that the present invention is equally well suited for use in wall systems or any other type of building systems wherein two adjacent panels are to be locked together in assembly. It should be further noted that the apparatus of the present invention is ideally suited for use in an outdoor environment wherein the joint is to be exposed to the elements. The present apparatus is fully able to close the seam between panels to provide a secure weathertight joint therebetween.

Figure 2:
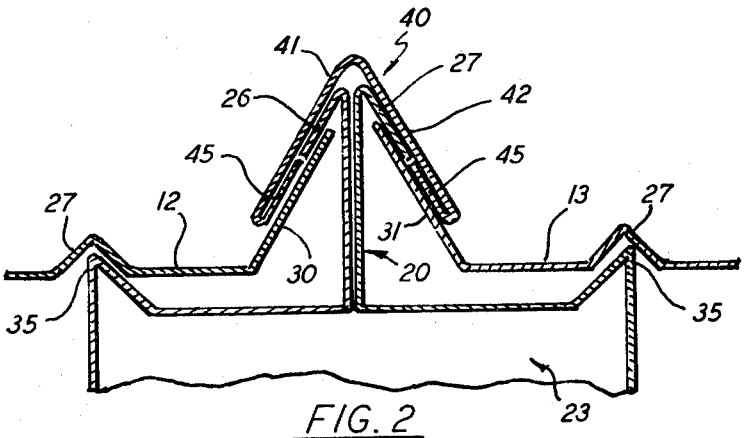
FIG. 2 is an enlarged partial end view in section of the joint shown in FIG. 1.

As best seen in FIGS. 1 and 2, roof panels 12 and 13 are placed in coplanar alignment in assembly with the adjacent edges of the panels forming a linear seam extending along the length of the panels. As is typical in most building systems of this nature, a support column 15 is positioned behind the panels with the column being centered upon the seam. The present column is formed of two sheetmetal members 16 and 17 that are placed in face to face alignment to establish a flanged support beam. The column contains a central web that is made up of an upper section 20 and a lower section 21. An upper flange 23 and a lower flange 24 both depend laterally to both sides of the web. The lower flange is generally rectangular in form while the upper flange is specifically contoured as will be described in greater detail below to receive and position the panels thereupon. The two sheetmetal members making up the column are secured together by means of a number of spring-like clips 25 that are passed through the abutting lower sections of the web (FIG. 1).

With particular reference to FIG. 2, the upper section of the web is arranged to pass upwardly through the seam opening formed between panels. The web is raised upwardly some distance above the edge of the panels. A pair of opposed obliquely positioned runners 26,27 which are cantilevered from the vertically extended body of the web, extend outwardly and downwardly from the distal edge of the web. In assembly, the two runners pass along the length of the seam and overlie the adjacent ends of the two panels. Although the runners may be secured to the web by any suitable means, in the present embodiment of the invention, the runners are formed by simply turning the ends of the two web halves downwardly away from the web as shown in FIGS. 1 and 2.

The two adjacent end sections of the panels which form the seam are turned upwardly and outwardly away from the plane of the panel to form oblique end sections 30 and 31. In assembly the end sections are positioned under the runners as illustrated in FIG. 2 with the edges of the end sections abutting the vertical wall of web section 20. The upper surface of each oblique end section generally compliments the bottom surface of the overlying companion runner. In practice, the oblique edge sections of the panels are brought well under the runners to provide sufficient overlap so that the ends of the panels are well shielded by the runners.

A V-like notch 27—27 is formed in each panel a predetermined distance in from the upturned edge of the panel. The notch extends upwardly from the top surface of the panel and extends along its entire length. The notch is arranged to be seated upon one of the raised embossments 35—35 carried on both ends of upper flange 23 of the column. The embossments serve to accurately position the panels on the column so that its oblique end section is snugly seated under the runner and the edge of the panel located in close proximity to the web of the support column. The embossments also function to prevent the panels from shifting laterally and thus widening the seam at the joint.

Figure 3:
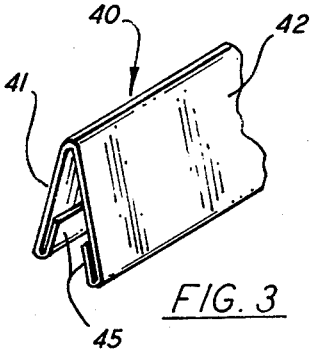
FIG. 3 is a perspective view of a closure spring used in the apparatus of the present invention.

A snap-on closure spring 40 (FIG. 3) is used to close the joint and secure the component parts in assembly. The closure is formed from a single piece of resilient metal. In an unloaded condition the closure defines an inverted V-shaped structure. The length of the spring closure device is about equal to the length of the seam established between the panels. The two legs 41 and 42 of the spring closure are of equal length and the distal edge of each leg is folded over upon itself to provide a locking pad 45 situated upon the inner surface of the leg which runs along the entire length of the spring closure.

To close the joint, the spring closure device is passed over the top of the runners with one leg of the spring closure straddling one runner and the second leg straddling the other runner. A downward force is applied to the apex of the spring closure whereupon the legs are caused to slide down over the top surfaces of the runners. The legs are forced apart as they move down the runners thereby producing an inwardly directed pressure against the pads. As the pads pass over the edge of the runners, the legs are snapped into biasing contact against the runners to lock the assembly in place.

As illustrated in FIG. 2, when the spring closure is snapped in place, the two pads are seated against the top surfaces of the two oblique end sections 30 and 31. At the same time, the top edge of each pad is situated in juxtaposition with the bottom edge of the adjacent runner thereby preventing the spring closure from moving out of the locking position. Under the biasing force of the now loaded spring closure, the inside surfaces of the closure legs are urged tightly against the underlying surfaces of the runners to provide a relatively tight joint which is capable of preventing moisture from penetrating into the joint region.

As can be seen from the disclosure above, the components forming the joint of the present invention are capable of being joined together in assembly without the aid of threaded fasteners, nails or the like. Through use of the easy to operate closure means, the seams between wall or roof panels can be rapidly and efficiently closed without the need of special tools to provide an effective joint that is generally impervious to the elements.

While this invention has been described with reference to the details as set forth above, it is not limited to the specific structure as disclosed and the invention is intended to cover any modifications or changes as may come within the scope of the following claims.

I claim:

1. Apparatus for joining a pair of coplanar panels to a metal support beam to provide a weathertight joint that includes a metal support beam having a generally horizontal support flange and a pair of back to back vertical web sections that extend upwardly from the flange and which are turned downwardly away from each other to form a pair of opposed oblique runners that are disposed along the length of the beam, a pair of flat sheetmetal roof panels, each panel being supported upon the flange of said beam on either side of the raised web section, the adjacent ends of the panel being obliquely turned in an upward direction under one of the overlying runners to form an overlapping joint therewith, a V-shaped spring having a pair of downwardly disposed legs, the ends of which are folded inwardly upon themselves to form a pair of locking pads, the inside surfaces of the legs being biased in contact against the outside surfaces of the two opposed runners and the pads passed beneath the joints into contact with the adjacent obliquely turned ends of the panels, and locking means acting between the flange of the beam and each of the panels for preventing the panels from moving laterally towards and away from the web section whereby the panels are locked to the beam.

2. The apparatus of claim 1 wherein said locking means includes an upraised embossment extending along the length of the flange on either side of the web section that is arranged to seat within a complimentary receiving groove formed in the overlying panel.

* * * * *